US005657656A

United States Patent [19]

Evans et al.

[11] Patent Number: 5,657,656

[45] Date of Patent: Aug. 19, 1997

[54] AUTOMATIC POSITIONING SYSTEM FOR A HOSE ASSEMBLY AND METHOD THEREFOR

[75] Inventors: Bryce B. Evans, Jackson; William J. Weed, Dexter, both of Mich.

[73] Assignee: Aeroquip Corporation, Maumee, Ohio

[21] Appl. No.: 578,166

[22] Filed: Dec. 29, 1995

[51] Int. Cl.[6] ..... B21D 41/04

[52] U.S. Cl. ..... 72/14.8; 72/31.06; 72/402; 72/461; 29/237

[58] Field of Search ..... 72/461, 402, 31.04, 72/31.06, 14.8, 21.1, 20.2; 29/237

[56] References Cited

U.S. PATENT DOCUMENTS

| | | | |
|---|---|---|---|
| D. 280,201 | 8/1985 | Moreiras et al. | D15/123 |
| 2,429,387 | 10/1947 | Buchheim | 72/461 |
| 3,820,377 | 6/1974 | Roch | 72/14.8 |
| 4,244,091 | 1/1981 | Kimble et al. | 29/237 |
| 4,285,228 | 8/1981 | Gunning | 72/402 |
| 4,494,312 | 1/1985 | Roch | 72/461 |
| 4,785,656 | 11/1988 | Kennedy | 72/402 |
| 5,211,045 | 5/1993 | Shimizu | 72/461 |
| 5,501,095 | 3/1996 | Dilger | 72/461 |

FOREIGN PATENT DOCUMENTS

| | | | |
|---|---|---|---|
| 2249063 | 4/1974 | Germany | 72/461 |
| 136525 | 10/1980 | Japan | 72/402 |
| 31345 | 2/1994 | Japan | 72/461 |

*Primary Examiner*—Daniel C. Crane

*Attorney, Agent, or Firm*—Emch, Schaffer, Schaub & Porcello Co., L.P.A.

[57] ABSTRACT

An automatic positioning system that includes positioning means for positioning a hose assembly adjacent a crimping apparatus. Actuator means is in communication with the positioning means to cause the positioning means to move. Control means is in communication with the actuator means to control movement of the positioning means. The method of the present invention includes the steps of: (a) actuating a positioning means to cause the positioning means to move; (b) controlling movement of the positioning means by control means so that the positioning means is in proper position with respect to a crimping apparatus; and (c) placing a hose assembly on the positioning means.

14 Claims, 7 Drawing Sheets

AUTOMATIC POSITIONING SYSTEM FOR A HOSE ASSEMBLY AND METHOD THEREFOR

BACKGROUND OF THE INVENTION

The present invention relates generally to an automatic positioning system for positioning a hose assembly adjacent a hose crimping apparatus and a method therefor. More specifically, the invention is directed to a system to axially locate a hose fitting relative to the crimping die of a hose crimping apparatus. The system provides motion and control in two axes such that the fitting is centered and placed at the proper depth within the crimping die. The system also provides a means for supporting and securing the hose assembly during crimping of the hose fitting onto the hose.

It is known in the art that proper axial positioning of the hose fitting with respect to the crimping apparatus is an important element in the construction and manufacture of reliable hose assemblies. In the past, axial positioning was accomplished through visual sighting by the operator of the crimping apparatus. This process was inefficient and resulted in a high percentage of unreliable hose assemblies. In an attempt to solve the problems associated with visual sightings, mechanisms that limit the insertion depth of the hose fitting, such as end stops, were employed. These mechanisms have limited utility due to the large number of end configurations found on hose fittings, i.e., pipe thread, elbows, flare, hexnut, etc. Axial positioning has also been accomplished by using the back edge of the hose fitting. This entailed using a device that was placed within the crimping die, or part of the die itself, and placing the back edge of the fitting adjacent the device to provide proper axial positioning. This type of device had limited utility because it tended to work only with specific types of fittings and specific crimp dies. Further, this device was not adjustable to accommodate several types of hose fittings.

In view of the foregoing, there is a need for a system and a method therefor that can properly and accurately position several types of hose fittings relative to a crimping die of a hose crimping apparatus. The system should include a control device, such as a computer, that can position the hose assembly in proper alignment with the crimping die. The system should reduce axial positioning variability and allow any operator to construct a high quality hose assembly in an easy and efficient manner. The present invention satisfies this need.

SUMMARY OF THE INVENTION

The present invention is directed to an automatic positioning system for positioning a hose assembly having a hose and a fitting adjacent a hose crimping apparatus and a method therefor. The system includes a positioning device for positioning the hose assembly adjacent the crimping apparatus. The positioning device includes a locator having a fitting alignment member that includes a hose support surface and a fitting alignment edge. An edge of the hose fitting engages the fitting alignment edge. The system further includes an actuator device that causes the positioning device to move. The actuator device includes at least two motors that move the positioning device along two axes of movement with respect to the crimping apparatus. A control device, such as a computer, is in communication with the actuator device to control the movement of the positioning device. The control device includes a program in which information concerning several types of hose assemblies and crimping apparatus is located. The operator of the crimping apparatus can manipulate the control device to cause the positioning device to position the hose assembly in proper alignment with the crimping die of the crimping apparatus. Once the hose assembly is properly positioned with respect to the crimping apparatus, a gripping device grips the hose of the hose assembly and the positioning device is withdrawn. The hose fitting is then crimped to the hose to form the final hose assembly.

The method of the present invention is directed to positioning a hose assembly having a hose and a fitting adjacent a crimping apparatus in which the steps are as follows: (a) actuating a positioning device to cause the positioning device to move; (b) controlling movement of the positioning device by control device so that the positioning device is in proper position with respect to the crimping apparatus; and (c) placing the hose assembly on the positioning device.

It is the primary object of the present invention to provide an automatic positioning system for a hose assembly having a hose and a fitting adjacent a crimping apparatus and a method therefor.

It is an important object of the present invention to provide an automatic positioning system that can accommodate several types of hose fittings and crimping apparatus.

It is another important object of the present invention to provide an automatic positioning system for a hose assembly that provides motion and control in two axes such that a hose fitting is centered and placed at the proper depth within the crimping die of a crimping apparatus.

It is still another important object of the present invention to provide an automatic positioning system for a hose assembly that is highly efficient.

Other objects and advantages of the present invention will become apparent to those skilled in the art upon a review of the following detailed description of the preferred embodiments and the accompanying drawings.

DETAILED DESCRIPTION OF THE PREFERRED EMBODIMENTS

Figure 1:
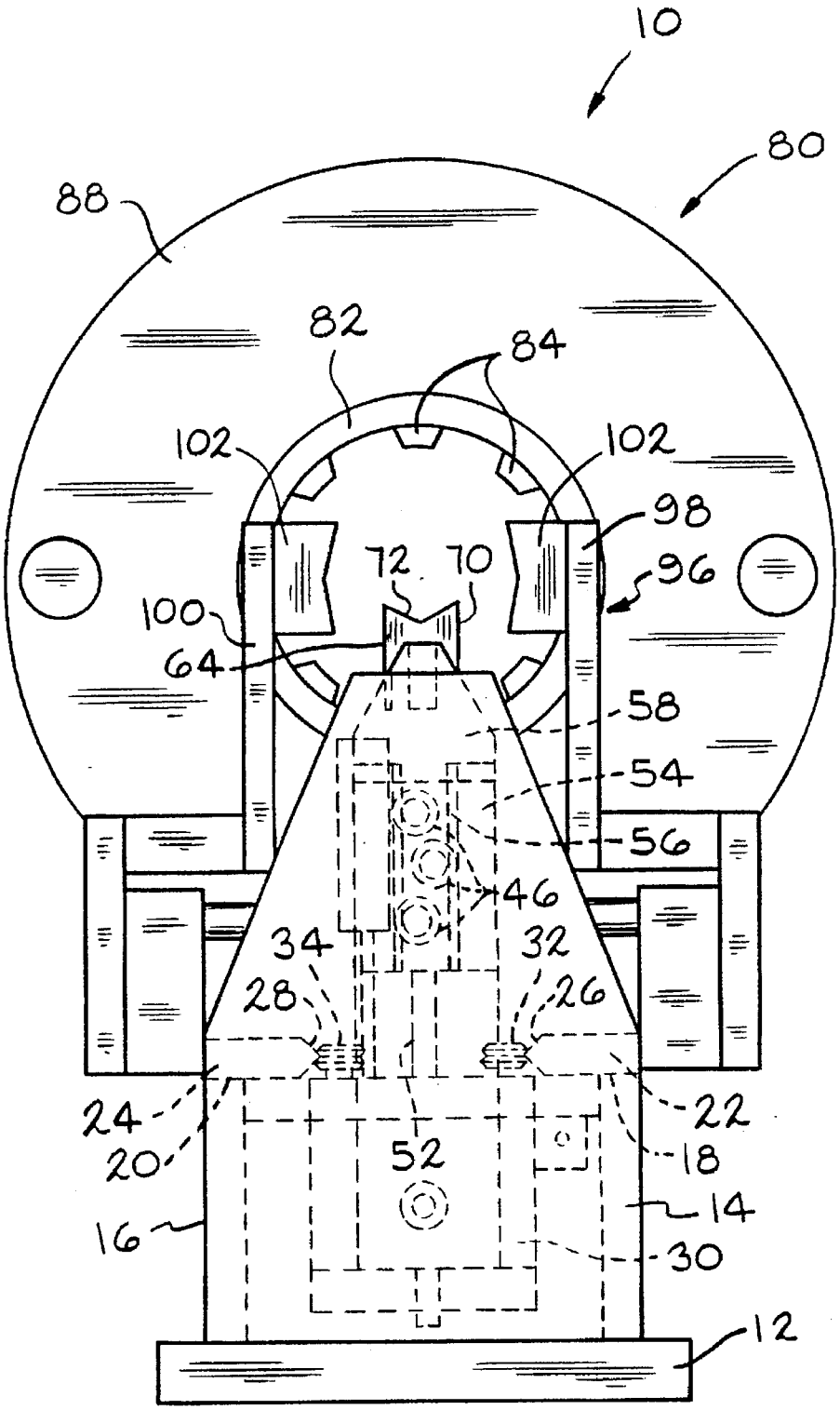
FIG. 1 is a front elevational view of the automatic positioning system for a hose assembly according to the present invention adjacent a crimping apparatus.

The preferred embodiments and best mode of the present invention will now be described in detail with reference being made to the drawings. The automatic positioning system of the present invention will be indicated generally in the drawings by the reference number "10".

Figure 2:
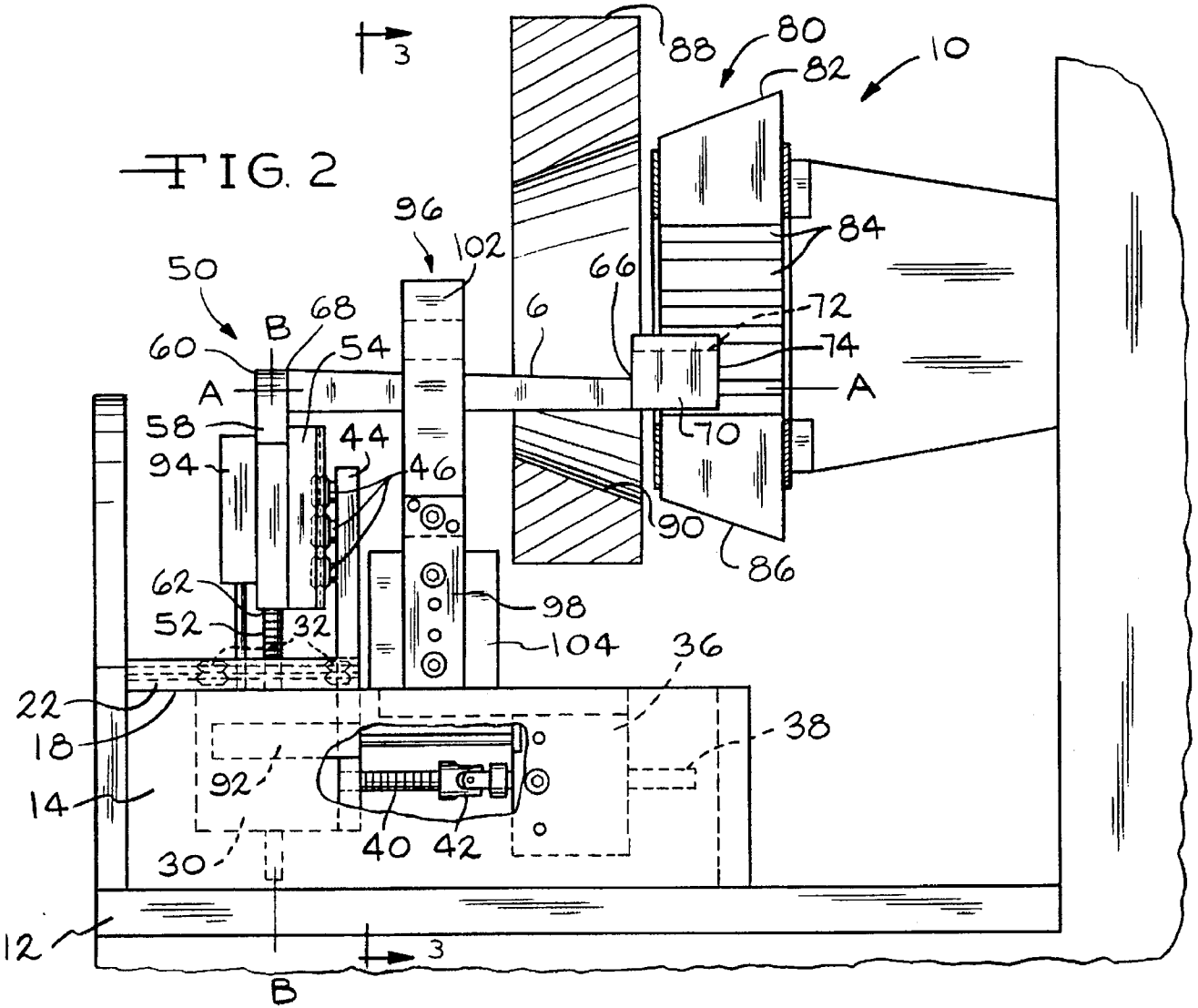
FIG. 2 is a side elevational view of the automatic positioning system according to the present invention.
Figure 3:
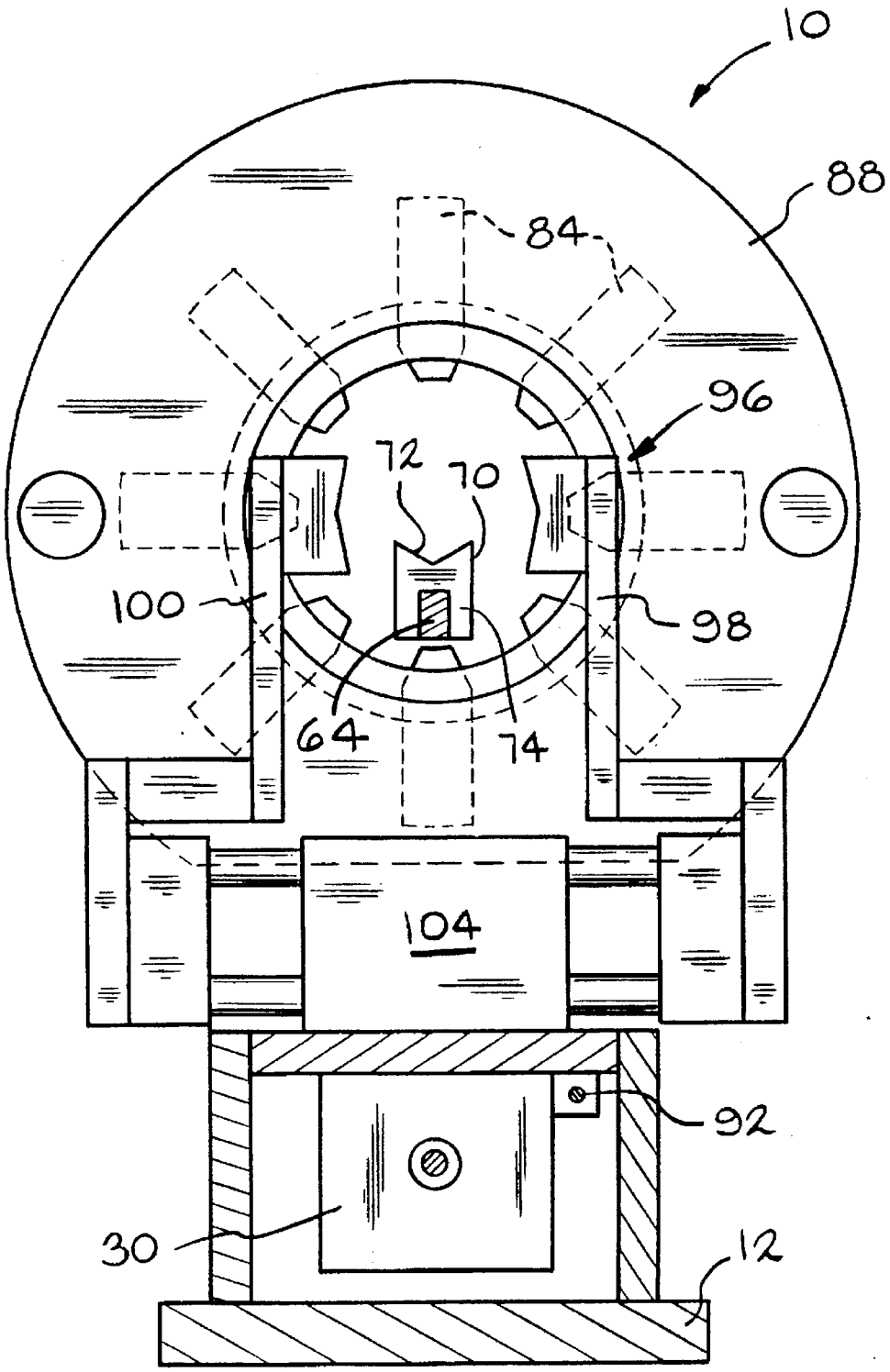
FIG. 3 is a cross-sectional view taken through line 3—3 of FIG. 1.

Referring to FIGS. 1, 2 and 3, the system 10 includes a base 12. First and second side walls 14 and 16 extend upwardly perpendicular from the base 12. The first and second side walls 14 and 16 include first and second upper surfaces 18 and 20, respectively. First and second guide bars 22 and 24 are mounted on the first and second upper surfaces 18 and 20, respectively. The first and second guide bars 22 and 24 extend longitudinally with respect to the base 12. The first and second guide bars 22 and 24 include first and second roller engagement surfaces 26 and 28, respectively.

Still referring to FIGS. 1, 2 and 3, a first motor 30 is movably mounted on the first and second guide bars 22 and 24 by first and second sets of rollers 32 and 34, respectively. The first set of rollers 32 engages the first roller engagement surface 26 and the second set of rollers 34 engages the second roller engagement surface 28. Movement of the first motor 30 is caused through interconnection of the first motor 30 with a fixedly mounted second motor 36. As shown in FIG. 2, a drive shaft 38 of the second motor 36 is connected to a fixed shaft 40 on the first motor 30 by a universal joint 42. When the second motor 36 is actuated, the drive shaft 38 turns thereby causing the horizontal movement of the first motor 30 and its attachments. The first and second motors 30 and 36 can be electric stepper or servo motors. As described below, these motors can be in communication with feedback sensors or transducers to provide position control.

As shown in FIGS. 1 and 2, a support member 44 extends upwardly from the first motor 30. A third set of rollers 46 is mounted on the support member 44.

Referring to FIGS. 1, 2 and 3, the system 10 includes a positioning device 50. The positioning device 50 is connected to the first motor 30 by a screw drive 52. When the first motor 30 is actuated, the positioning device 50 is moved vertically. As shown in FIGS. 1 and 2, proper vertical alignment of the positioning device 50 is maintained by a guide plate 54 having a channel 56 in which the third set of rollers 46 is positioned. The guide plate 54 is fixedly attached to a locator support 58 that includes a top end 60 and a bottom end 62. The locator supporter 58 is attached to the screw drive 52 at the bottom end 62.

As shown in FIG. 2, the positioning device 50 includes a locator 64 having a first end 66 and a second end 68. The second end 68 is fixedly attached to the top end 60 of the locator support 58. A fitting alignment member 70 is fixedly attached to the first end 66 of the locator 64. Referring to FIGS. 1, 2 and 3, the fitting alignment member 70 includes a hose support surface 72 and a fitting alignment edge 74.

Still referring to FIGS. 1, 2 and 3, the locator 64 is positioned adjacent a crimping apparatus 80. The crimping apparatus includes a crimping die 82 having a plurality of teeth 84. The crimping die 82 includes an exterior surface 86. During a crimping operation, a crimping cylinder 88 having an interior surface 90 engages the exterior surface 86 of the die 82 to cause the plurality of teeth 84 to extend toward and engage a hose fitting to crimp the fitting onto a hose. The fitting alignment member 70 is positioned adjacent the crimping apparatus 80.

As shown in FIG. 2, the locator 64 can move in two axes of movement with respect to the crimping apparatus 80. The locator 64 can move horizontally on a first axis of movement A. The horizontal movement of the locator 64 is accomplished by actuation of the second motor 36, which is in communication with the locator 64 through connection of the locator with the first motor 30. The locator 64 can also move along a second axis of movement B. Movement along axis B causes the locator 64 to move vertically. The vertical movement of the locator 64 is caused by first motor 30, which is in communication with the locator through the locator support 58 and screw drive 52.

The movement of the locator 64 along axes A and B is sensed by first and second feedback sensors 92 and 94. The first feedback sensor 92 is positioned on the first motor 30. The first feedback sensor 92 senses movement of the first motor 30 as the locator moves along axis A. The second feedback sensor 94 is attached to the locator support 58. The second feedback sensor senses movement of the locator 64 along axis B. Thus, the position of the fitting alignment member 70 with respect to the crimping apparatus 80 can be monitored.

Referring to FIGS. 1, 2 and 3, the system 10 includes a gripping device 96 adjacent the positioning device 50. The gripping device 96 grips a hose of a hose assembly during the crimping process. The gripping device 96 includes two opposed arms 98 and 100 each having gripping portions 102 for engaging the hose. In the present embodiment, the arms 98 and 100 are in communication with a conventional pneumatic pump and motor unit 104. When the pneumatic pump and motor unit 104 is actuated, the gripping portions 102 of the arms 98 and 100 move toward each other to grip and secure the hose.

Figure 10:
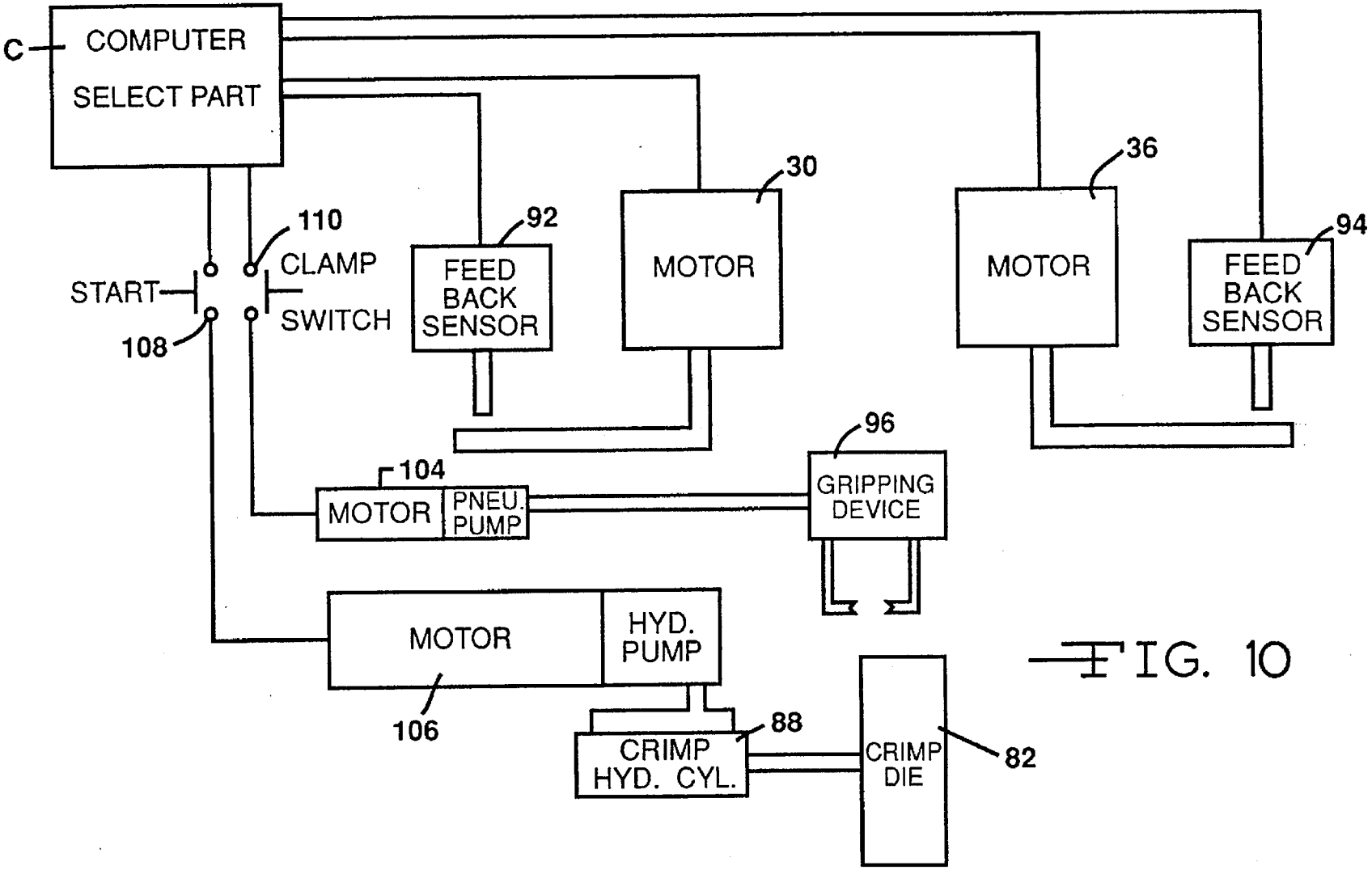
FIG. 10 is a schematic view showing the various components of the automatic positioning system of the present invention in communication with the control device.

Referring to FIG. 10, the system 10 includes a control device, such as a computer C, to properly control and sequence the movement of the various components of the system. The computer C is in communication with the first and second motors 30 and 36 and the first and second feedback sensors 92 and 94. The computer C is in communication with the gripping device 96 through the pneumatic pump and motor unit 104. A conventional hydraulic pump and motor unit 106, which actuates the crimping cylinder 88 of the crimping apparatus 80, is in communication with the computer C. The system 10 includes an on/off switch 108 and a clamp switch 110 for actuating the pneumatic pump and motor unit 104.

The computer C can be a microprocessor. The microprocess or can range from a small microcontroller with an LCD read-out to a personal computer, depending on the memory and networking requirements of the system 10. In the preferred embodiment, the computer C is a conventional personal computer. The computer C includes a program (not shown) that allows the operator of the system 10 to select the proper crimp dimensions from information stored in the computer's memory. The computer C prompts the operator to select, among other things, the crimp die that is currently installed and the crimp die that is required to form a certain hose assembly. The computer C then confirms the selected crimp dimensions. As shown in FIG. 10, the computer C transmits signals to enable the first and second motors 30 and 36 to properly position the locator 64 with respect to the crimping apparatus 80. The movement of the motors is monitored by the first and second feedback sensors 92 and 94. The computer C also sequences movement of the system 10 so that the hose assembly may be positioned, held in place, and properly crimped without damage to the locator 64. After the hose assembly is completed, the computer C stores information concerning the type of hose and fittings used, as well as the selected crimp dimensions.

Figure 4:
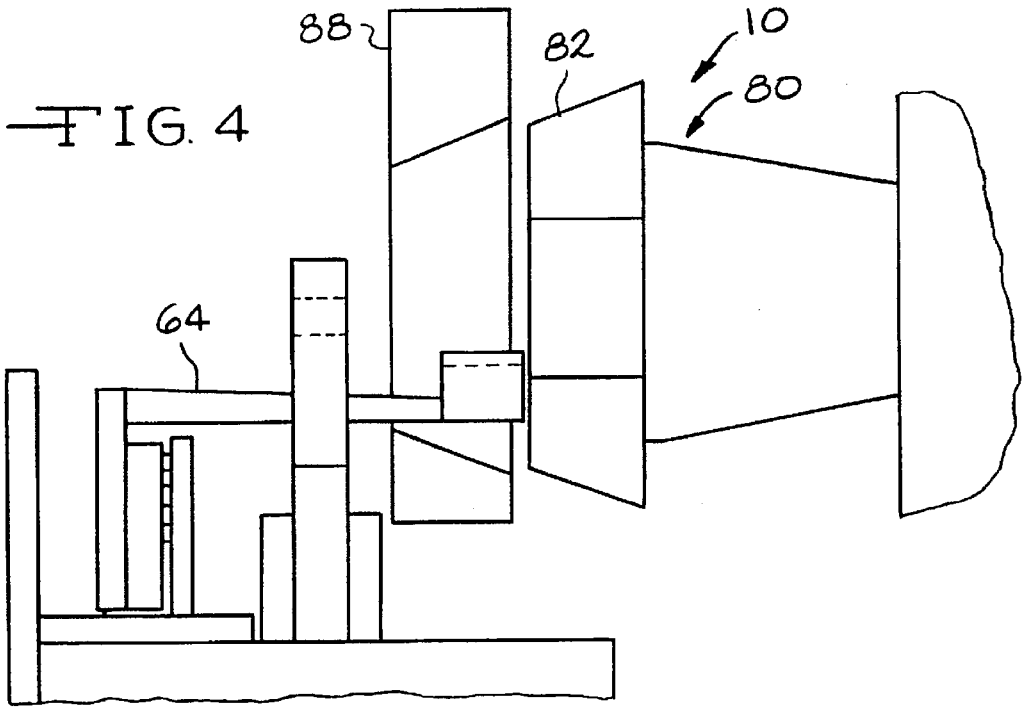
FIG. 4 is a schematic view similar to the detailed of FIG. 2.
Figure 5:
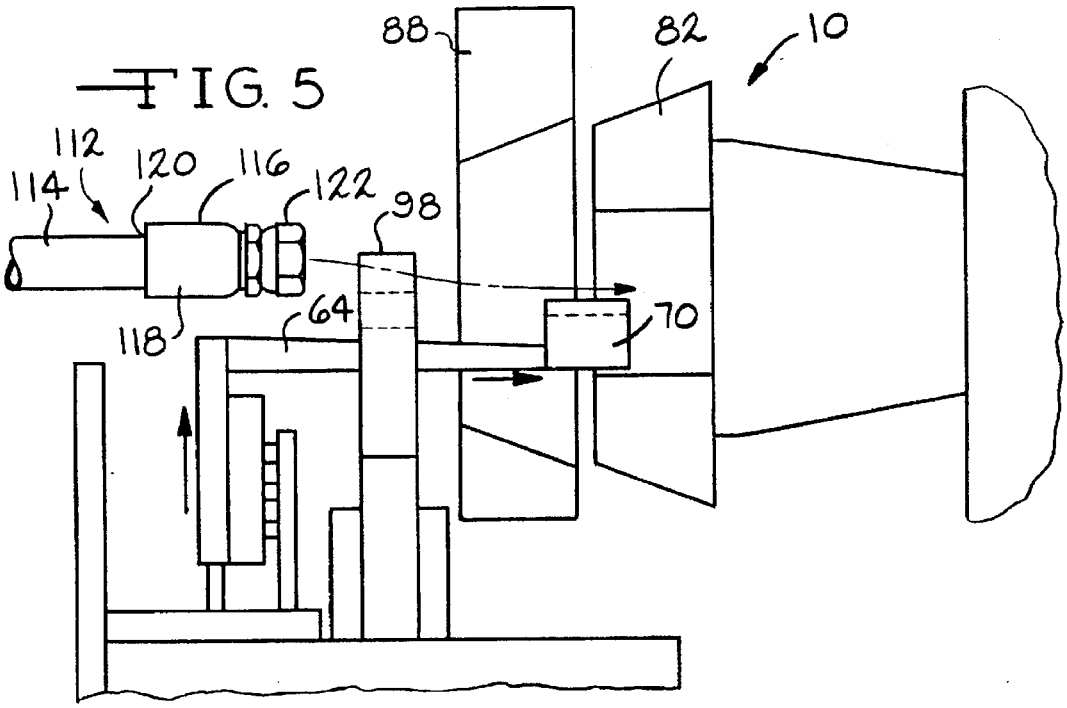
FIG. 5 is a schematic view showing movement of the positioning device according to the present invention and the placement of the hose assembly on the positioning device.
Figure 6:
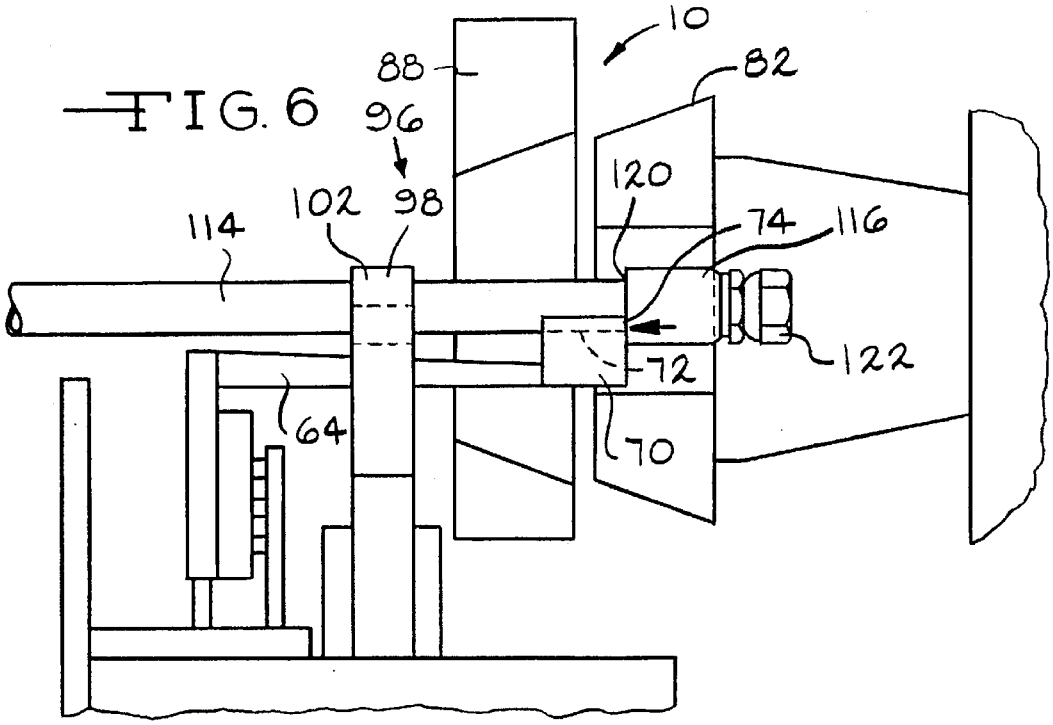
FIG. 6 is a schematic view showing the hose fitting of the hose assembly being positioned adjacent the positioning device.
Figure 7:
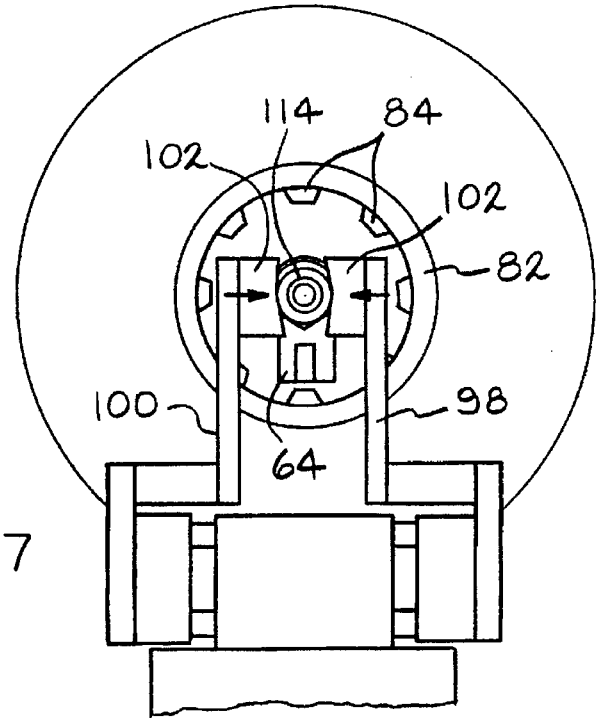
FIG. 7 is a schematic view showing the gripping device securing the hose of the hose assembly.
Figure 8:
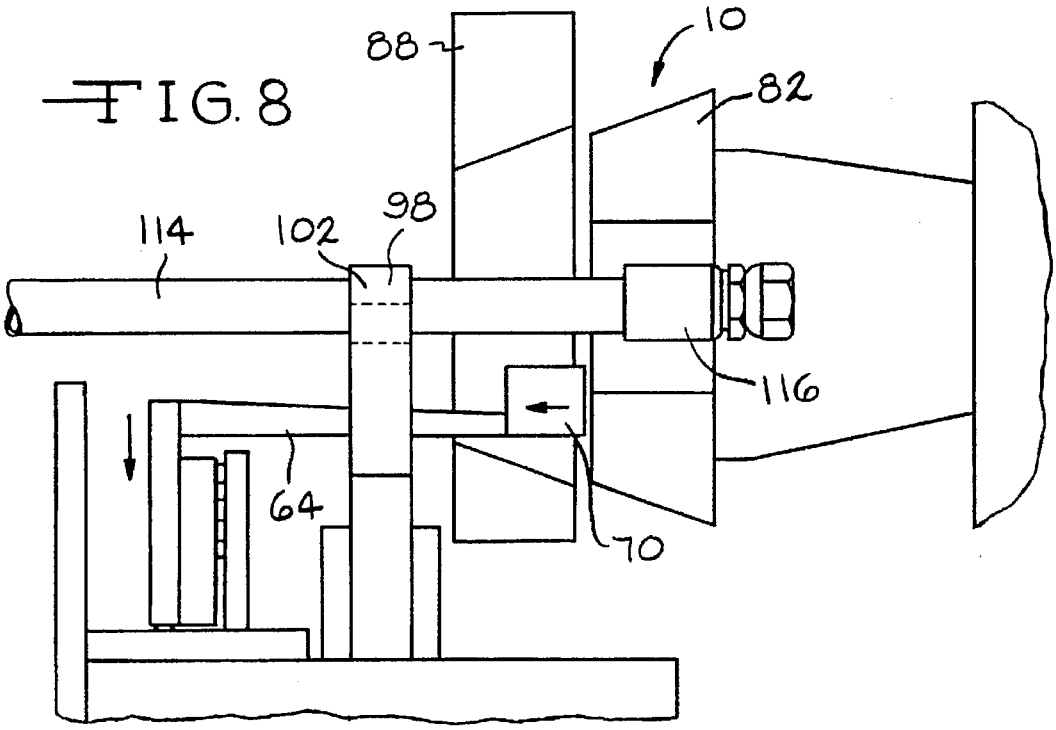
FIG. 8 is a schematic view showing the hose of the hose assembly being gripped by the gripping device and the retraction of the positioning device.
Figure 9:
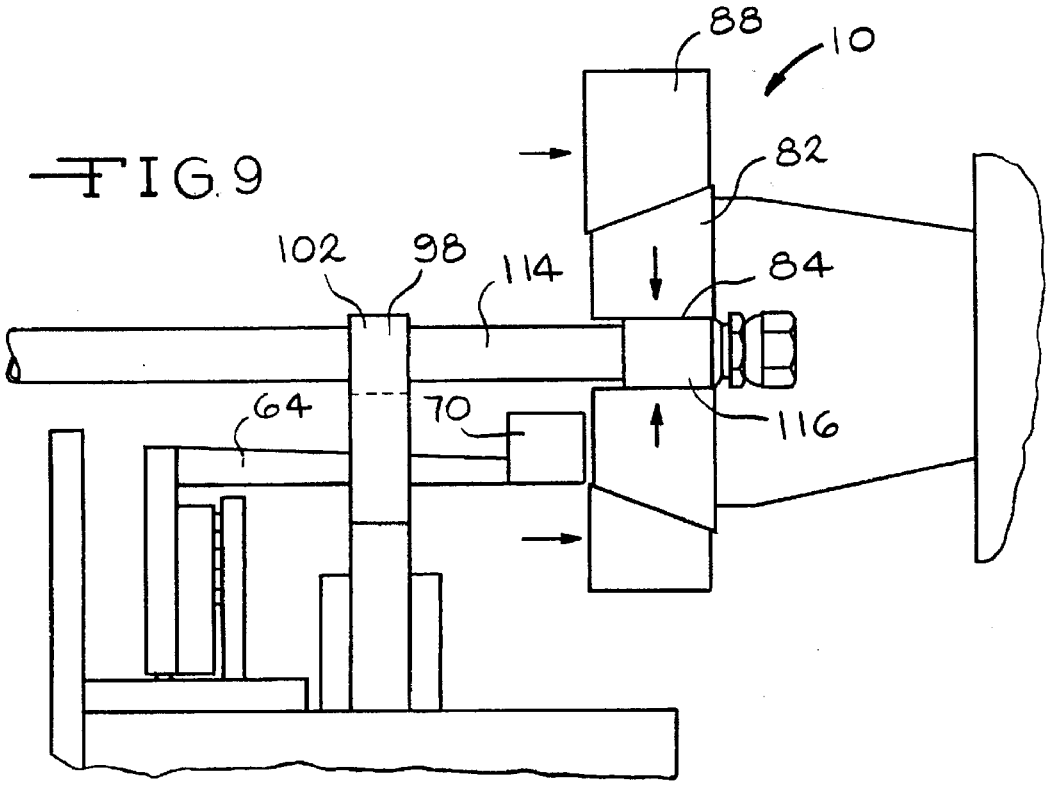
FIG. 9 is a schematic view showing the crimping die of the crimping apparatus crimping the hose fitting onto the hose.

The operation of the system 10 and the method of the present invention will now be described with reference being made to FIGS. 4 through 9. As shown in FIG. 4, the locator 64 is positioned adjacent the crimping apparatus 80. Referring to FIG. 5, the system 10 is used to assemble a hose assembly 112 having a hose 114 and a fitting 116. The fitting 116 includes a body 118 having an edge 120. In the embodiment shown in FIG. 5, the fitting 116 includes a hex end 122. It should be understood that the fitting 116 can include a variety of shapes and sizes depending on the application. When the hose assembly 112 is to be assembled, the operator manipulates the computer C so that the computer can send signals to properly position the locator 64 with respect to the crimping apparatus 80. The locator 64 can be moved along the two axes of movement as indicated by the arrows in FIG. 5. Once the locator 64 is in proper position with respect to the crimping apparatus 80, the hose assembly 112 is positioned on the fitting alignment member 70. As shown in FIG. 6, the hose 114 is positioned on the hose support surface 72. The edge 120 of the fitting 116 is positioned so that it engages the fitting alignment edge 74. When so positioned, the hose assembly 112 is properly aligned with the crimping die 82. After the hose assembly 112 has been positioned on the locator 64, the gripping device 96, which includes arms 98 and 100, grips the hose 114 to firmly support the hose assembly 112 as shown in FIG. 7. Referring to FIG. 8, the locator 64 is moved in the directions indicated by arrows so that the fitting alignment member 70 and the rest of the locator 64 is retracted from the crimping die 82. This prevents damage to the locator 64 by the crimping teeth 84. As shown in FIG. 9, after retraction of the locator 64 from the crimping die 82, the hydraulic pump and motor unit 106, which is in communication with the crimping cylinder 88, is actuated causing the crimping cylinder to move in the direction indicated by the arrows to engage the crimping die 82 to move the plurality of crimping teeth 84 in the direction indicated by the arrows. The teeth 84 engage the fitting 116 to properly crimp the fitting on the hose 114. After the crimping process is complete, the crimping cylinder 88 is reversed thereby causing the retraction of the teeth 84. The completed hose assembly 112 can then be released and removed for use. The above-described cycle can be repeated.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

We claim:

1. A positioning system for positioning a hose assembly having a hose and a fitting adjacent a crimping apparatus, comprising:

a locator having a fitting alignment member for positioning said hose assembly adjacent said crimping apparatus;

motor means in communication with said locator for causing movement of said locator along horizontal and vertical axes with respect to said crimping apparatus; and at least one computer in communication with said motor means for controlling movement of said locator.

2. The positioning system of claim 1, wherein said fitting alignment member includes a hose support surface and a fitting alignment edge.

3. The positioning system of claim 1, wherein said motor means consists of at least two electric motors.

4. The positioning system of claim 3, wherein said motors are each in communication with at least one feedback device.

5. The positioning system of claim 1, wherein said system further includes gripping means adjacent said locator for gripping said hose assembly adjacent said crimping apparatus.

6. The positioning system of claim 5, wherein said gripping means consists of at least two opposed arms each having gripping portions for engaging said hose of said hose assembly.

7. The positioning system of claim 5, wherein said gripping means is in communication with said computer.

8. A method for positioning a hose assembly having a hose and a fitting adjacent a crimping apparatus, comprising the steps of:

(a) actuating a locator having a fitting alignment member by motor means to cause said locator to move along horizontal and vertical axes with respect to said crimping device;

(b) controlling movement of said locator by at least one computer in communication with said motor means to position said locator with respect to said crimping apparatus; and (c) placing said hose assembly on said locator.

9. The method of claim 8, wherein said fitting alignment member includes a hose support surface and a fitting alignment edge.

10. The method of claim 8, wherein said motor means consists of at least two electric motors.

11. The method of claim 8, wherein said motors are each in communication with at least one feedback device.

12. The method of claim 8, wherein said method includes the step of:

(d) gripping said hose of said hose assembly with gripping means once said hose fitting is positioned on said locator.

13. The method of claim 12, wherein said gripping means consists of at least two opposed arms each having gripping portions for engaging said hose.

14. The method of claim 12, wherein said gripping means is in communication with said computer.

* * * * *